US005492520A

United States Patent [19]

Brown

[11] Patent Number: 5,492,520

[45] Date of Patent: Feb. 20, 1996

[54] ABDOMINAL EXERCISER DEVICE

[76] Inventor: Donald Brown, P.O. Box 432, Chester, N.J. 07930

[21] Appl. No.: 271,525

[22] Filed: Jul. 7, 1994

[51] Int. Cl.[6] ..... A63B 23/02

[52] U.S. Cl. ..... 482/140; 482/132; 482/142

[58] Field of Search ..... 482/10, 78, 95, 482/96, 131, 132, 133, 140, 144, 142; 297/258, 260, 272, 408; 472/135; D21/193

[56] References Cited

U.S. PATENT DOCUMENTS

| | | | |
|---|---|---|---|
| 1,244,371 | 10/1917 | Reynolds | 297/260 |
| 2,429,939 | 10/1947 | Masterson et al. | 482/142 |
| 2,563,407 | 8/1951 | Haims | 297/258 |
| 2,722,967 | 11/1955 | Reinholz | 482/142 |
| 3,591,173 | 7/1971 | Cossman | 135/67 |
| 4,367,870 | 1/1983 | Birch | 297/258 |
| 4,527,833 | 7/1985 | Parker | 297/408 |
| 4,595,234 | 6/1986 | Kjersem | 297/258 |
| 4,729,562 | 3/1988 | Pipasik | 482/137 |
| 4,752,067 | 6/1988 | Colonello | 482/140 |
| 4,863,158 | 9/1989 | Tassone | 482/140 |
| 4,902,003 | 2/1990 | Buoni | 482/140 |
| 5,407,404 | 4/1995 | Killian et al. | 482/130 |

FOREIGN PATENT DOCUMENTS

| | | | |
|---|---|---|---|
| 3632124 | 4/1988 | Germany | 482/140 |

*Primary Examiner*—Richard J. Apley
*Assistant Examiner*—Jeanne M. Clark
*Attorney, Agent, or Firm*—McAulay Fisher Nissen Goldberg & Kiel

[57] ABSTRACT

The abdominal exerciser device is made of a one piece skeletal frame. The frame defines a pair of support rails, a pair of arcuate rocker portions, a pair of arm rest portions and an upstanding arch-shaped portion connecting the support rails together. Removable cushions are disposed on the arm rest portions to receive the elbows of the user when in a supine position. The head and neck of a user are supported on a support extending across the arch-shaped portion. The rocker portions are curved on a circular arc to mimic the curvature of the spine of the user.

11 Claims, 3 Drawing Sheets

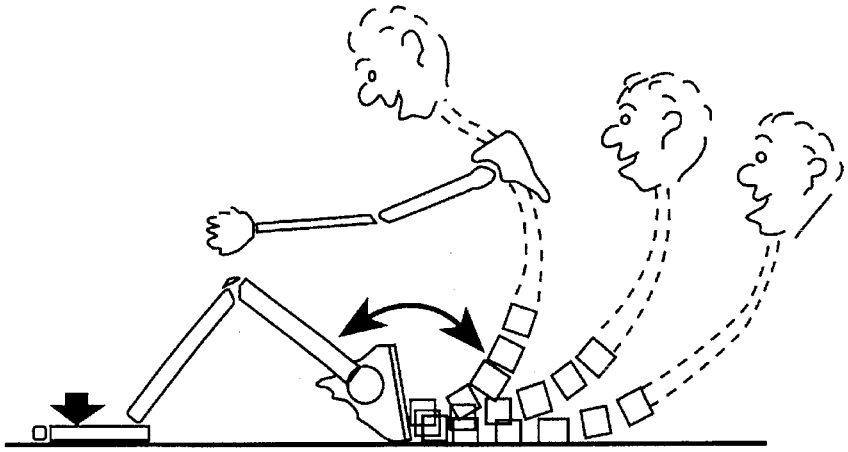
FIG. 1
FIG. 2
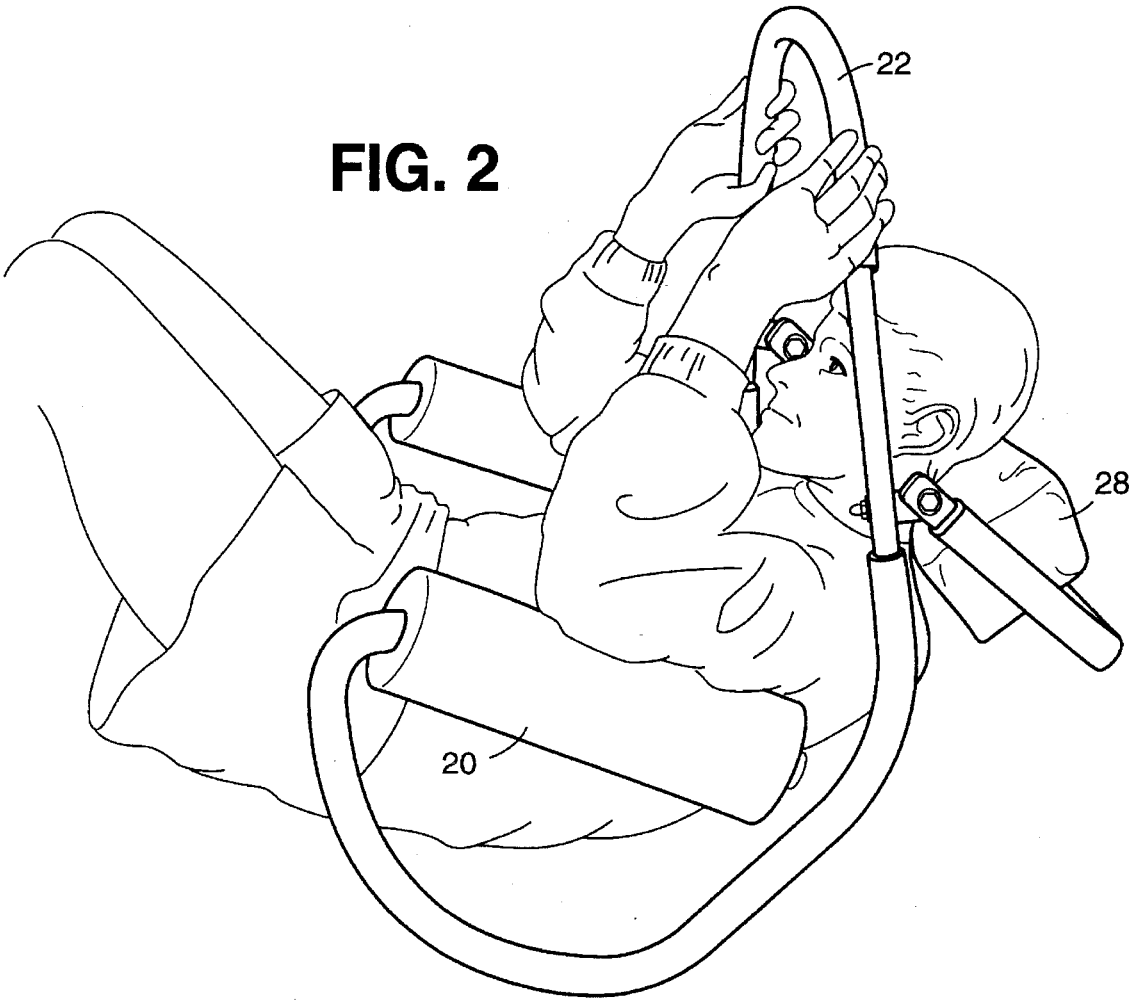

ABDOMINAL EXERCISER DEVICE

This invention relates to an exerciser device. More particularly, this invention relates to an abdominal exerciser device.

As is known, various types of exercisers have been developed for exercising particular muscles of the human body. For example, one relatively popular exercise for exercising the muscles of the abdomen is known as a "sit-up". During such an exercise, a person lying in a supine position with knees flexed into an upward position and hands behind the neck, slowly curls and uncurls his/her upper body so as to bring the head towards the stationary knees. Variations of this exercise include starting from a fully flexed position and lowering to an intermediate position which is held before returning to the upright position. Typically, the purpose of these types of abdominal flexion exercises is to require the upper torso to flex in a curling and uncurling manner so as to bring about a strengthening of the muscles of the abdomen and related areas.

It has also been known to employ various types of devices to enhance an exercise program. For example, machines have been known wherein the user performs an exercise, such as a curling and uncurling exercise, against a resistance accorded by the machine. In some cases, the resistance is variable during the exercise. In one known exercise machine used to increase the strength of the abdominal muscles, the user is seated in an upright position rather than being in a supine position. Further, during curling and uncurling, the user works against a bar which is mounted in a cantilever manner on an arm which pivots about a fixed point and which is driven to pivot forwardly and rearwardly.

Generally, exercise machines are relatively expensive, particularly where motors and variable weights are involved. Also, such motor driven exercise machines can be relatively heavy and cumbersome so that transportation and storage are not easy.

Accordingly, it is an object of the invention to provide a relatively simple exercise device for strengthening the abdominal muscles.

It is another object of the invention to provide a relatively simple low-cost abdominal exerciser device.

It is another object of the invention to provide an abdominal exercise device which can be readily transported from place to place and readily stored.

It is another object of the invention to provide a light-weight abdominal exerciser device.

Briefly, the invention provides an abdominal exerciser device which is comprised of a pair of support rails for resting on a support surface, a pair of arcuate rocker portions each of which extends forwardly from a respective support rail and a pair of arm rest portions, each of which extends rearwardly from a rocker portion to receive an elbow or arm of a person disposed between the support rails in a supine position.

When in use, the person rests his or her elbows or arms on the arm rest portions while in a supine position and then curls his/her body forwardly while rocking on the arcuate rocker portions. Repeated rearward and forward rocking allows the user to strengthen the abdominal muscles.

The exercise device is preferably constructed of a skeletal frame, for example using a single hollow tube or the like to define the support rails, rocker portions and arm rest portions. In addition, the tube defines an upstanding arch-shaped portion connected to and between the support rails to define a space to receive the head of a person disposed between the support rails.

A support means is also secured to and across the arch-shaped portion of the skeletal frame for supporting the neck and head of a person disposed between the support rails. Thus, during an exercise program, the weight of a person's head, neck and upper body are transferred through the support means into the arch-shaped portion of the frame and, thus into the support rails, rocker portions and arm rest portions and, thus, to the arms of the user. In a sense, the user conducts a mild isometric contraction by applying a force through his/her arms into the exercise device which, in turn, causes lifting of the head, neck and upper body of the person when contracting the abdominal muscles.

The support means which is disposed across the arch-shaped portion may include a weight means which can be varied from time-to-time. For example, the support means may include a pouch which can be filled with sand or the like from time to time so as to increase the weight in the support means.

The arcuate rocker portions are disposed on a circular arc and, for example, an arc which has a radius of 6¾ inches and which extends over an angle of 135° so as to mimic the curvature of the spine of an average person. The arcuate length of the rocker portions is thus approximately 16 inches for an average sized person.

The support rails may have a straight contour or a curved contour between the respective rocker portions and the arch-shaped portion. As the support rails are intended to define a support position when the person is in the supine position, the support may be of any particular contour.

The skeletal frame may be made of any suitable material, such as a hollow metal tube, a solid metal rod or a suitable plastic material. In this respect, the material which is used should be one which is relatively rigid so as to absorb repeated curling and uncurling motions without fatiguing.

The exerciser device may also be provided with a cushion on the free end of each arm rest portion in order to comfortably receive the elbow of a person disposed between the support rail.

These and other objects and advantages of the invention will become more apparent from the following detailed description taken in conjunction with the accompanying drawings wherein:

FIG. 1 schematically illustrates the positions of a body during an abdominal exercise;

FIG. 2 illustrates a perspective view of an exerciser device during use with a user in a supine position in accordance with the invention;

Referring to FIG. 1, during an abdominal flexion exercise a person may start from a supine rest position and move to an extended upright position. For example, the exercise may be of a sit-up variety wherein the exerciser moves the upper body from a supine position to the fully upright position illustrated in FIG. 1. Other variations of the exercise may begin from a fully flexed position with the body being gradually lowered to an intermediate position which is sustained before returning to the upright position. Generally, during such exercises, the arms are held near the knees to prevent excessive extension and the knees are flexed upwardly as illustrated.

As indicated in FIG. 1, when curling from a supine position to the fully flexed position, the average spine moves over an angle of 45° relative to the supine position.

Figure 3:
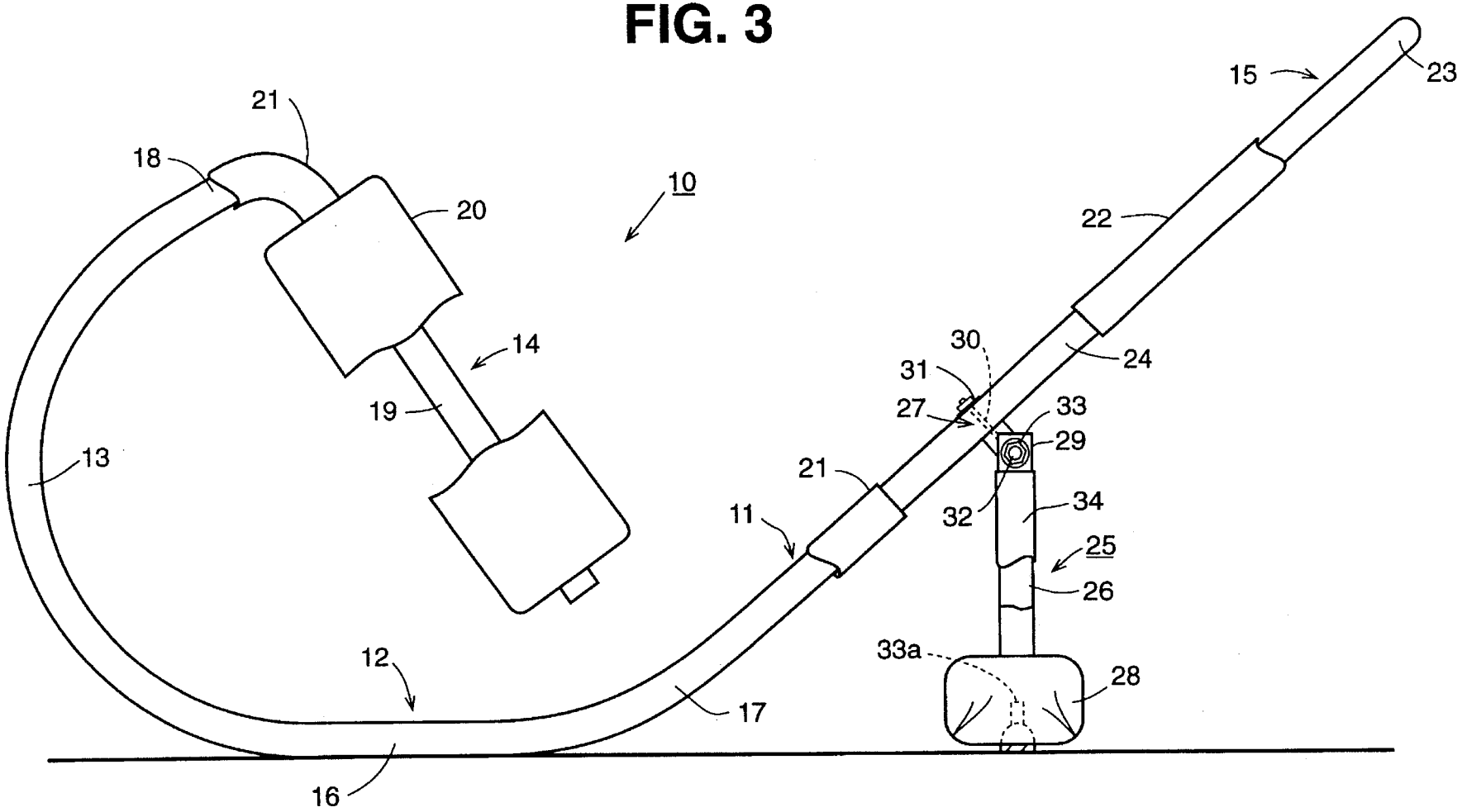
FIG. 3 illustrates a side view of the exerciser device in a rest position in accordance with the invention.
Figure 4:
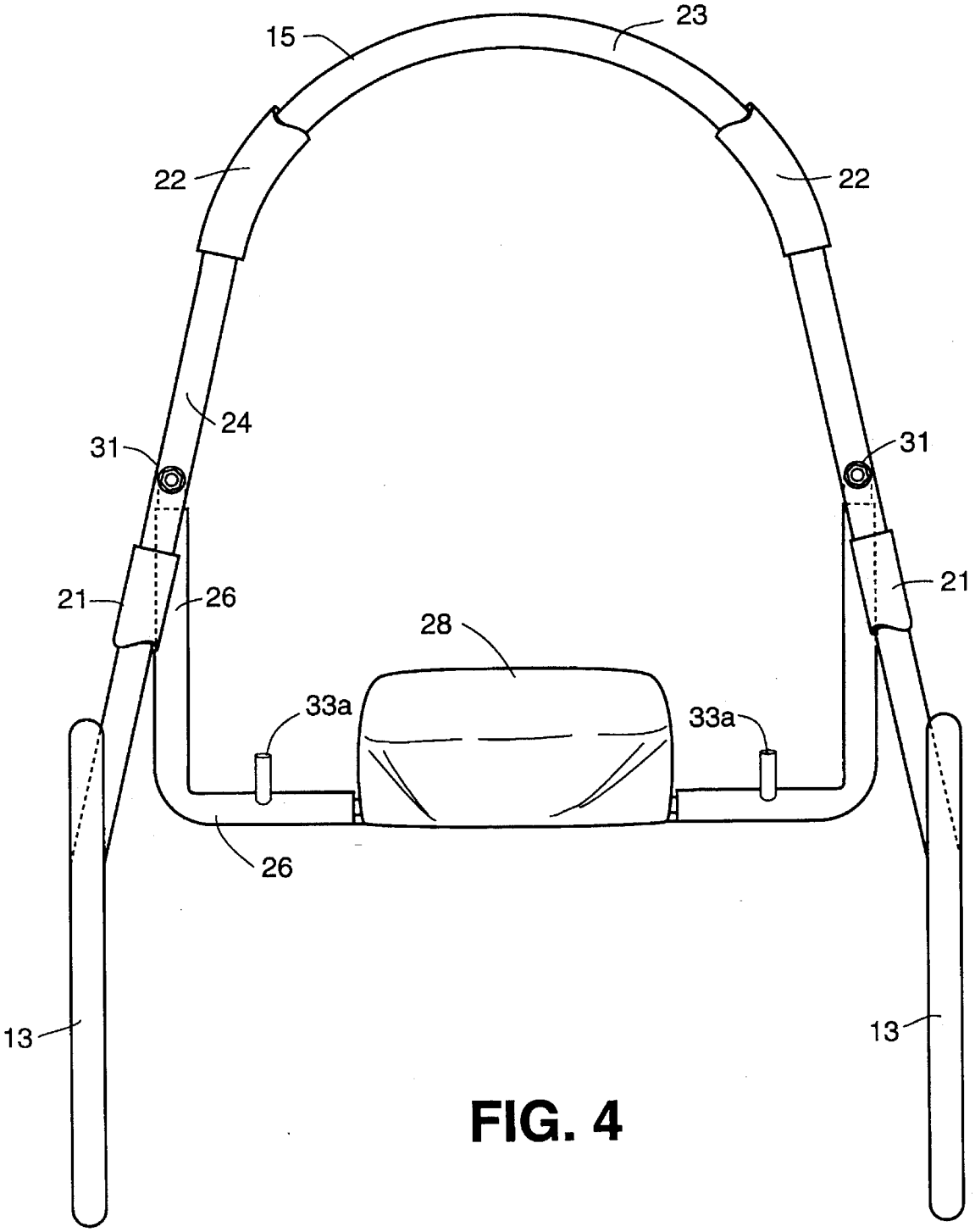
FIG. 4 illustrates a front view of the skeletal abdominal exerciser device of FIGS. 2 and 3.

Referring to FIGS. 3 and 4, the abdominal exerciser device 10 is formed of a skeletal frame 11, for example from a single hollow tube of aluminum or other rigid material. The skeletal frame 11 includes a pair of support rails 12, a pair of arcuate rocker portions 13, each of which extends forwardly from a respective support rail 12, a pair of arm rest portions 14, each of which extends from a respective rocker portion 13 and an upstanding arch-shaped portion 15 which is connected to and between the support rails 12.

The support rails 12 are laterally spaced from each other to rest on a support surface, such as a floor. Each support rail 12 extends between a rocker portion 13 and the arch-shaped portion 15 and, as illustrated, each support rail 12 includes a straight portion 16 which extends from a rocker portion 13 and an arcuate portion 17 extending rearwardly from the straight portion 16. Each straight portion 16 may have a length of, for example, 3 inches while the arcuate portion 17 is disposed on an inside radius of 6¾ inches. As such, the straight portion 16 may serve to support the exerciser device 10 on a flat surface while also indicating an initial position corresponding to a supine position of the user. Each arcuate portion 17 extends to the arch-shape portion 15 such that the arch-shape portion 15 defines an angle of 50° with the horizontal when the straight portions 16 of the support rails 12 are parallel and on a flat horizontal surface.

Each arcuate rocker portion 13 is disposed on a circular arc, and in particular, on an inside radius of 6¾ inches. This dimension has been found to be the most suitable for a mid-range mid-height person to mimic the pivoting motion of a spine during a curling exercise program. In addition, each rocker portion 13 extends over an angle of 135° and is of a length of approximately sixteen (16) inches.

As shown in FIG. 4, the two rocker portions 13 are parallel to each other but may also be directed inwardly towards each other at a small angle to accommodate the elbows of the person using the exerciser device 10. For example, the rocker portions 13 may define a clear space of twenty-five (25) inches.

Referring to FIG. 3, each arm rest portion 14 extends from a rocker portion 13 and is bent over to form an L-shape. As indicated, each arm rest portion 14 has a curved portion 18 extending from a rocker portion 13 and a straight free end portion 19 of, for example, a length of 11¼ inches. The curved portion 18 forms a right angle bend. In addition, the free end portion 19 has a removable cushion 20 mounted thereon to receive an elbow or arm of the person disposed between the support rails. The cushion 20 may also be made integral with the arm rest portion 14 where desired. As illustrated, the cushion 20 is a tubular cylindrical member of resilient material, such as a foam rubber or plastic, which can be simply slid onto the free end portion 19.

As indicated in FIGS. 2 and 3, a sleeve 21 of non-slip material, such as rubber or the like, is disposed over each support rail 12 and rocker portion 13. Each sleeve 21 also extends along a part of the arch-shaped portion 15. Thus, the sleeve 21 serves to maintain the exerciser device 10 in a stable condition when being used by an exerciser.

The sleeves 21 may be made of a friction type material so as to provide a non-slip type surface to retard the exerciser device 10 from slipping on a floor during an exercise program. In addition, a mat (not shown) may be provided for a user to lie on in a supine position with the exerciser device 10 resting on the mat. Such a mat may be made of any suitable cushion material with a non-slip surface. For example, the mat may be made of a closed cell foamed plastic such as a polyvinylchloride. Any other suitable type of cushion material may also be used. Such a mat serves to not only provide a cushioned surface for the user, but also cooperates with the sleeves 21 on the exerciser device 10 to preclude slippage of the exerciser device 10 when in use.

As indicated in FIGS. 2 and 4, a similar sleeve 22 is disposed on the upper apex portion of the arch-shaped portion 15 of the exerciser 10 in order to provide a firm hand-gripping surface. The arch-shaped portion 15 extends upwardly and rearwardly and is of a generally U-shaped contour as indicated in FIG. 4. The arch-shaped portion 15 is sized so as to define a space to receive the head of a person disposed between the support rails 12.

As shown in FIG. 4, the upper part of the arch-shaped portion 15 has a central arcuate portion 23 having an inside radius of 6¾ inches while extending over an angle of 133.5°. A straight side portion 24 extends from the arcuate portion 23 on a straight line to merge into the support rail 12. By way of example, the length of each straight portion 24 is fifteen (15) inches.

In an alternative construction (not shown) the upper part of the archshaped portion 15 may have a central arcuate portion which extends parallel to the plane of the arm rest portions 14 and the cushions 20 thereon. This configuration provides a more comfortable position of use for a user particularly where the user is able to rest his/her arms on the cushions 20 while grasping the arch-shaped portion with his/her hands. This configuration also provides a limited contoured shape which facilitates packaging and shipping.

This additional embodiment also permits a user to grasp the apex of the arch-shaped portion during an exercise routine without having the user rest his/her arms or elbows on the arm rest cushions 20.

Referring to FIGS. 2 and 3, a support means 25 is secured to and across the arch-shaped portion 15 for supporting the neck and head of a person disposed between the support rails 12. As shown, the support means 25 includes a rigid U-shaped bar 26, for example, of aluminum which is pivotally mounted by suitable means 27 on the straight portions 24 of the arch-shaped portion 15. In addition, the support means 25 includes a padded head rest 28 which is secured to a horizontal part of the U-shaped bar 26.

The U-shaped bar 26 is freely pivotable relative to the arch-shaped portion 15 so as to be moved from a position as shown in FIG. 3 in which the bar 26 is vertical and rests on a floor or on other support surface.

The pivot means 27 is constructed, for example, of a self-aligning ball bearing 29 that automatically adjusts to the flexion of different sized individuals. The bearing 29 has a threaded pin 30 which passes through a straight portion 24 of the arch-shaped portion 15 and which receives a threaded nut 31 to secure the bearing 29 in place. A bolt 32 passes through the bearing 29 and one end of the bar 26 while receiving a pair of lock nuts 33 on the end to hold the bar 26 in place. The U-shaped bar 26 is thus allowed to rotate relative to the ball bearing 29.

As indicated, the U-shaped bar 26 is covered by a rubber sleeve 34 or the like in order to provide a friction surface or to enhance the aesthetic appearance of the exerciser device 10.

When the U-shaped bar 26 is in a vertical position resting on a support surface, the support rails 12 are spaced from the support surface so that the exercise device is in a position to start on the radius of the arcuate rocker portions 13. In this regard, the legs of the U-shaped bar are approximately 5½ inches long.

The padded head rest 28 may be of any suitable type, for example, of block-like shape as illustrated. Alternatively, the padded head rest 28 may be of contoured shape so as to provide for a head and neck support.

When the exerciser device 10 is in a position of rest, as shown in FIG. 3, the user may perform an exercise which involves resting one's head on the head rest 28 while grasping the arch-shaped portion 15 and resting one's arms and elbows on the arm rest cushions 20. At this time, the user may raise his/her legs into a vertical position. The legs may then be lowered while being maintained in a parallel relation.

Referring to FIG. 4, weight means may be removably mounted on the support means 25 from time-to-time to increase the resistance to pivoting of the exercise device 10, for example, as a user reaches a higher level of strength, the weights may be added to the support means 25. To this end, the U-shaped bar 26 is provided with pegs 332, each of which is disposed to an opposite side of the head rest 28. Each peg 332 may be in the form of a one-inch diameter urethane dowel so as to receive a weight thereon, such as a standard two one-half pound weight. Of course, any weight of a suitable size may be used. Alternatively, the added weights may be otherwise secured to the U-shaped bar 26 from time-to-time. For example, a block of plastic (not shown) may be mounted on the bar 26 to each side of the head rest 28. In addition, each block may be provided with three bores, for example of cylindrical shape, each of which is to slidably receive a weight. For example, the bores may have different diameters so as to receive cylindrical weights of different diameters and weights sizes. For example, two bores may be sized to receive cylindrical two pound weights while the third bore is of smaller size to receive a one pound weight. In this way, a variable resistance system is provided that may go from two pounds to ten pounds in two pound increments.

Alternatively, the support means 25 may be removably mounted on the arch-shaped portion 15 via clips or the like. In addition, the support means 25 may include a weight means which can be varied in magnitude from time to time to provide a variable resistance. For example, the support means 25 may be in the form of a pouch which contains eyelets to receive clips attached to the arch-shaped portion 15 of the exercise device 10. The eyelets provide a means to permit a ready attachment of the pouch. In addition, the pouch may be provided with one or more pockets to receive a weight means, such as sand. In this way, the pouch may be filled with more or less sand so as to increase or decrease the weight of the pouch and thus the resistant weight which is being lifted by the user.

The cushions which are disposed on the arm rest portions 19 may also be of flat contour with a slight over hang at the forward end so as to permit gripping by a user. In this respect, any suitable means may be used to secure the flat arm rest cushions in place.

In order to conduct an exercise program for exercising the abdominal muscles, the following steps are followed:

First, the user positions himself or herself in a supine position within the skeletal frame 11 of the exerciser device 10 as indicated in FIG. 2 while placing his or her neck and head on the head rest 28 of the support means 25. Next, the user rests his or her elbows on the arm rest portions 14, that is, on the cushions 20 on the arm rest portions 14 as illustrated in FIG. 2. The user is now ready to begin a curling exercise. At this time, with the user's hands gripping the upstanding arch-shaped portion 15, the user begins to curl his or her spine forwardly while rocking the frame 11 forwardly on the rocker portions 13.

After reaching a partially flexed or fully flexed position, the user returns to the supine position while rocking the skeletal frame 11 rearwardly on the rocker portions 13. The curling and uncurling steps are repeated until the exercise program has been completed.

The exercise device 10 may be used in various manners.

For example, with a user disposed in a supine position with head resting on the padded head rest 28, with feet flat on the floor and with the knees elevated, the user may perform a reverse curl by bringing his/her knees up to his/her chest.

For a beginner level program of exercise, the user would lie in a supine position with head resting on the head rest, feet flat on the floor, knees elevated and arms outstretched and flat on the arm rest cushions 20. Simple curling of the body causes the exercise device to rock forwardly on the rocker portions 13. The user would then rotate rearwardly on the rocker portions 13 to complete a cycle.

For an intermediate level program of exercise, the user would grip the arch-shaped portion 15 with his or her hands while resting his or her elbows on the arm rest cushions 20. Curling would then be performed in a similar manner as above. In this position, the weight of the arms of the user create an overload condition. In the beginner level, the weight of the arms are forward of the user so that an overload condition is not present.

For an advanced level program, the user would extend his or her arms upwardly through and behind the arch-shaped portion 15 so as to rest against the upper ends of the arch-shaped portion 15. Curling would then occur with the exercise device being rocked on the rocker portions 13. During this time, the weight of the arms provides a fully overloaded condition to enhance the exercise program.

In all levels of exercise, the head of the user rests comfortably on the padded head rest 28 and is fully supported by the exerciser device 10.

The exerciser device 10 serves to completely isolate the abdominal muscles. Typically, in a basic sit-up, stress is imposed on the back of the neck. Such stressing can be taken away from the back of the neck by placing one's arms in a simple fixed position on the exerciser device while allowing the neck to be completely supported so that there is no stress or energy wasted on the head. Further, the exerciser device 10 supports the spinal structure of a user as one unit instead of individual vertebrae which occurs during a single sit-up. Since the rocker portions 13 rock in a smooth fashion, the rocker portions 13 transfer all the load to the abdominal muscles so that there is no stress to any vertebrae, the lower back or the neck. Consequently, there is a total isolation of the abdominal muscles.

The invention thus provides a skeletal abdominal exerciser device which is of light weight construction. As such, the exerciser device can be readily transported and stored in an easy manner. Further, because of the relatively simple construction, the exerciser device may be made in low-cost manner, The exercise device may also be constructed in multiple pieces e.g. two or three pieces that attach into one unit for packaging and shipping purposes.

Since the exerciser device 10 does not require any moving machine parts to perform an exercise routine, the user determines the extent to which the device is used. For example, instead of curling into a fully-flexed position, the user may determine to flex only to an intermediate position. During any such curling exercises, the user's muscles are working against each other. That is, the force of the arms on the exercise device 10 is transferred through the device to the neck and head and vice versa. Thus, the exercise device allows the curling exercise program to be facilitated and enhanced.

The exerciser device may be made in different sizes to accommodate different sizes of users. Further, the device may be made in a relatively simple manner for use by an individual at home or in a more robust manner for use as a commercial unit in health clubs and the like. The device may also be made with additional features, for example, stops may be provided on the forward ends of the rocker so as to provide an abutment to stop a forward pivoting of the exerciser device at a predetermined point.

One of the advantages of the exerciser device is that the curvature of the rocker portions mimics the curvature of the spine and, in particular, follows the strength curve of a spine.

The invention also provides an exerciser device which is able to firmly support a user's back while reducing stress on the neck, lower back and mid-back while allowing a strengthening of the abdominal muscles.

What is claimed is:

1. An abdominal exercise frame comprising a pair of arcuate rocker portions for receiving a person therebetween in a supine position, each rocker portion being disposed on a circular arc of a radius of 6¾ inches;

an upstanding portion connected to and between said rocker portions, said upstanding portion defining a space to receive a head of a person disposed between said rockers and providing a surface to be engaged by one of the hands or arms of a person in said supine position; and a pair of arm rest portions, each arm rest portion extending from a respective rocker portion at an end opposite said upstanding portion.

2. An abdominal exerciser device as set forth in claim 1 wherein each rocker portion is of a length of approximately 16 inches.

3. An abdominal exerciser device comprising a pair of laterally spaced support rails for resting on a support surface with a person disposed therebetween in a supine position;

a pair of laterally spaced arcuate rocker portions, each rocker portion extending forwardly from a respective one of said support rails for rocking of the device forwardly and rearwardly relative to said support rails;

a pair of arm rest portions, each arm rest portion extending rearwardly from a respective rocker portion to receive an elbow of a person disposed between said rails in a supine position;

an upstanding portion connected to and between said support rails and defining a space to receive a head of a person disposed between said support rails; and a support means secured to said upstanding portion for supporting the head and neck of a person disposed between said support rails.

4. An abdominal exerciser device as set forth in claim 3 wherein said support means includes a U-shaped bar pivotally mounted on said upstanding portion in depending relation and a padded head rest mounted on said U-shaped bar to receive a head of a person disposed between said rails.

5. An abdominal exerciser device as set forth in claim 3 wherein said upstanding portion, said support rails, said rocker portions and said arm rest portions are integral to form a one-piece skeletal frame.

6. An abdominal exerciser device as set forth in claim 3 which further comprises a cushion on a free end of each arm rest portion to receive an elbow of a person disposed between support rails.

7. An abdominal exerciser device as set forth in claim 6 wherein said cushion is a tubular cylinder removably mounted on a respective arm rest portion.

8. An abdominal exercise device of skeletal construction comprising a pair of parallel support rails for resting on a support surface with a person disposed therebetween in a supine position;

a pair of parallel arcuate rocker portions, each rocker portion extending from a forward end of a respective support rail for rocking of the device in a forward direction and a rearward direction relative to said support rails;

a pair of arm rest portions, each arm rest portion extending from a respective rocker portion to receive an elbow of a person disposed between said support rails;

a connecting portion extending from said support rails at ends opposite said rocker portions; and a support means secured to and across said connecting portion for supporting the neck and head of a person disposed between said support rails in a supine position while the person curls his/her body forwardly while rocking on said arcuate rocker portions.

9. An abdominal exerciser device comprising a pair of laterally spaced support rails for resting on a support surface with a person disposed therebetween in a supine position;

a pair of laterally spaced arcuate rocker portions, each rocker portion extending forwardly from a respective one of said support rails for rocking of the device forwardly and rearwardly relative to said support rails;

a support means secured to and across an arch-shaped portion, which is connected to and between said support rails, for supporting a head and neck of a person disposed between said support means;

a pair of arm rest portions, each arm rest portion extending rearwardly from a respective rocker portion to receive an elbow of a person disposed between said rails in a supine position; and each arm rest portion having a free end portion and cushion on said free end portion of each arm rest portion to receive an elbow of a person disposed between support rails, said cushion being a tubular cylinder removably mounted on a respective arm rest portion.

10. An abdominal exercise frame comprising a pair of arcuate rocker portions for receiving a person therebetween in a supine position;

an upstanding portion connected to and between said rocker portions, said upstanding portion defining a space to receive a head of a person disposed between said rocker portions and providing a surface to be engaged by one of the hands or arms of a person in said supine position;

a pair of arm rest portions, each arm rest portion extending from a respective rocker portion at an end opposite said upstanding portion; and a support means secured to and across said upstanding portion for supporting a head and neck of a person disposed between said rocker portions.

11. A frame as set forth in claim 10 wherein support means includes U-shaped bar pivotally mounted on said upstanding portion in depending relation and a padded head rest mounted on said U-shaped bar to receive a head and neck of a person disposed between said rails.

* * * * *

UNITED STATES PATENT AND TRADEMARK OFFICE

CERTIFICATE OF CORRECTION

PATENT NO. : 5,492,520
DATED : February 20, 1996
INVENTOR(S) : Donald Brown

It is certified that error appears in the above-identified patent and that said Letters Patent is hereby corrected as shown below:

Column 2, line 30 after "support" insert -rails-

Column 3, line 8 after "arch-shaped" insert -connecting-

Column 4, line 20, change "archshaped" to -- arch-shaped--.

Column 5, lines 14 and 16, change "332" to -33a-

Column 7, line 64 after "between" insert -said-

Column 8, line 34 change "means" to -rails-

Line 40, before "cushion" insert -a-

Line 62, after "includes" insert -a-

Signed and Sealed this

Tenth Day of March, 1998

Bruce Lehman

*Attest:*

BRUCE LEHMAN

*Attesting Officer*

*Commissioner of Patents and Trademarks*